US006925282B2

(12) United States Patent
Drawe et al.

(10) Patent No.: US 6,925,282 B2
(45) Date of Patent: Aug. 2, 2005

(54) RETRACTABLE AGGLOMERATION REMOVABLE BLADE WITH CLEANING MECHANISM AND PROCESS FOR AGGLOMERATION REMOVAL

(75) Inventors: Jeffrey W. Drawe, Bloomfield, NY (US); Robert S. Pozniakas, Rochester, NY (US); Steven R. LeRoy, Hilton, NY (US); Shengliang Zhang, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/672,491

(22) Filed: Sep. 26, 2003

(65) Prior Publication Data

US 2005/0069356 A1 Mar. 31, 2005

(51) Int. Cl.[7] ..... G03G 21/00
(52) U.S. Cl. ..... 399/349; 399/345; 399/350
(58) Field of Search ..... 399/349, 345, 399/343, 350, 353, 71, 101; 15/1.51, 256.5, 256.51, 256.52; 430/125

(56) References Cited

U.S. PATENT DOCUMENTS

| | | | | |
|---|---|---|---|---|
| 4,158,498 A | | 6/1979 | Ohmori | |
| 4,640,608 A | | 2/1987 | Higaya et al. | |
| 4,969,015 A | | 11/1990 | Sanpe | |
| 4,989,047 A | | 1/1991 | Jugle et al. | 399/349 |
| 5,031,000 A | | 7/1991 | Pozniakas et al. | 399/349 |
| 5,126,798 A | * | 6/1992 | LeRoy et al. | 399/349 |
| 5,175,591 A | | 12/1992 | Dunn et al. | 399/347 |
| 5,257,079 A | | 10/1993 | Lange et al. | 399/354 |
| 5,339,149 A | | 8/1994 | Lindblad et al. | 399/351 |
| 5,349,428 A | | 9/1994 | Derrick | 399/351 |
| 5,442,422 A | * | 8/1995 | Owens et al. | 399/350 X |
| 5,444,522 A | | 8/1995 | Owens, Jr. | |
| 5,493,383 A | | 2/1996 | Pozniakas et al. | 399/345 |
| 5,655,203 A | * | 8/1997 | Thayer et al. | 399/345 |
| 5,687,297 A | | 11/1997 | Coonan et al. | 395/102 |
| 5,732,320 A | | 3/1998 | Domagall et al. | 399/350 |
| 6,069,624 A | | 5/2000 | Dash et al. | 345/333 |
| 6,188,863 B1 | | 2/2001 | Gross et al. | 399/316 |
| 6,282,401 B1 | | 8/2001 | Proulx et al. | 399/350 |
| 2004/0022554 A1 | * | 2/2004 | Fina et al. | 399/350 X |

FOREIGN PATENT DOCUMENTS

| | | | |
|---|---|---|---|
| JP | 05-142971 A | * | 6/1993 |
| JP | 05323846 | | 7/1993 |
| JP | 05-323835 A | * | 12/1993 |
| JP | 06-230704 A | * | 8/1994 |

* cited by examiner

*Primary Examiner*—Sophia S. Chen

(57) ABSTRACT

A cleaning system and process for removing residual toner from an imaging surface, including a primary cleaner system for removing the predominant amount of residual toner and debris and a retractable secondary agglomeration cleaning blade mounted downstream from the primary cleaner, wherein, when the blade is moved into the engaged position, the cleaning edge is engaged with the imaging surface at for shearing release of agglomerations from the imaging surface and wherein the cleaning blade is movable to the retracted position during periods in which the primary cleaner is in its operative position.

27 Claims, 6 Drawing Sheets

RETRACTABLE AGGLOMERATION REMOVABLE BLADE WITH CLEANING MECHANISM AND PROCESS FOR AGGLOMERATION REMOVAL

BACKGROUND AND SUMMARY

The invention relates to a cleaning sub system in an imaging system and more particularly to a cleaning mechanism for removing residual toner and debris from a charge retentive surface including a secondary cleaning system for release and removal of agglomerations that are not cleaned therefrom at the primary cleaner.

In electrostatographic printing such as electrophotography, image transfer from the charge retentive surface to the printing substrate (such as paper) is known to at times be incomplete. In response, primary cleaning systems were developed to remove residual toner from the charge retentive surface prior to the next image development procedure. Such primary cleaning systems include one or more rotating electrostatic brushes, cleaning blades, electrostatic air cleaners, vacuum systems, and other similar systems used singly or in combination. For over a decade, the art of electrostatographic printing has understood that certain agglomerations of toner particles and other materials can stick to photoreceptors or other charge retentive surfaces sufficiently to resist removal by primary cleaning systems. Such agglomerations have multiple causes, including melting of toner resins, adherence of random glue materials transferred from printing substrates, paper fibers and other debris, and a combination of mechanical and electrostatic forces. Residual agglomerations can cause imaging defects such as streaks and spots. The longer the agglomerations are allowed to remain on the charge retentive surface, the harder they often become to remove. Additional material tends to build in the lee of initial agglomeration spots, and the combination of initial agglomerations and added material often forms agglomerations shaped like and sometimes named "comets".

In response, secondary cleaning systems were installed. As taught in U.S. Pat. No. 4,989,047 issued to Jugle et al. and U.S. Pat. No. 5,031,000 issued to Pozniakas, et al., such a secondary cleaning system can comprise a relatively hard cleaning "spot" blade located downstream from the primary cleaning system for the purpose of shearing agglomerations that resist initial cleaning away from the imaging surface. Various improvements to this secondary cleaning system have been introduced, including improved design of the blade to resist blade tucking (See, U.S. Pat. No. 5,349,428 issued to Derrick) and improved blade materials (See, e.g., U.S. Pat. No. 5,339,149 issued to Lindblad; U.S. Pat. No. 5,732,320 issued to Domagall et al.; and U.S. Pat. No. 6,282,401 issued to Proulx et al.) In particular, Lindblad is significant since it recognizes that friction between the blade and the charge retentive surface causes heat that in turn causes certain agglomerations to adhere even more tightly to the surface and further resist cleaning. Each of these references cited above are hereby incorporated herein in their entirety.

Even with the improvements referenced above, present techniques fail to completely remove harmful agglomerations. In particular, agglomerations that are lifted from the charge retentive surface sometimes stick to the spot blade itself rather than falling away or being removed by vacuum pressure. As the spot blade continues to press lightly against the photoreceptor or other charge retentive surfaces, stuck agglomerations slowly begin to mar the surface layers of the photoreceptor. Eventually, these micro-scratches wear enough from the photoreceptor that the scratches become visible in the developed images as streaks. At such time, good practice is to replace the photoreceptor. Often, the actual or expected appearance of such streaks sets the recommended time for replacement of the photoreceptor, even though, without such streaks, the photoreceptor remain within acceptable specifications for a considerably longer service life.

It would be desirable to have a spot removing system that successfully removes spots and that ameliorates the tendency for agglomerations on the spot blade to mar the surface of a photoreceptor or other charge retentive device. Such an improved spot removing system would decrease the cost of ownership of printing systems containing such system by extending the service life of a typical photoreceptor or other imaging surface. Additionally, image quality will be enhanced by ameliorating micro-scratches caused by such agglomerations.

One aspect of the invention is a cleaning system for removing residual toner from an imaging surface, comprising: a primary cleaner for removing the predominant amount of residual toner and debris, such primary cleaner having an operative position; a blade holder; an agglomeration cleaning blade mounted in the blade holder at a position downstream from the primary cleaner, said cleaning blade having a cleaning edge; and a forcing device for moving the blade between a first and a second position wherein the first and second position are selected from the group consisting of an engaged position and a retracted position; wherein, when the blade is moved into the engaged position, the cleaning edge is supported at a low angle of attack in engagement with the imaging surface at a relatively low load, for shearing release of agglomerations from the imaging surface and wherein the cleaning blade is movable to the retracted position during periods in which the primary cleaner is in its operative position.

Another aspect of the invention is a process for cleaning agglomerations from an imaging surface, comprising: removing the predominate amount of residual toner and debris from the imaging surface by a primary cleaner mechanism; engaging a cleaning edge of a cleaning blade with the imaging surface at a low angle of attack at a relatively low load for shearing release of agglomerations from the imaging surface; retracting the cleaning blade from the position in which it is engaged with the imaging surface; and cleaning the retracting cleaning blade by engaging the cleaning edge with a wiper mechanism.

DETAILED DESCRIPTION

Figure 1:
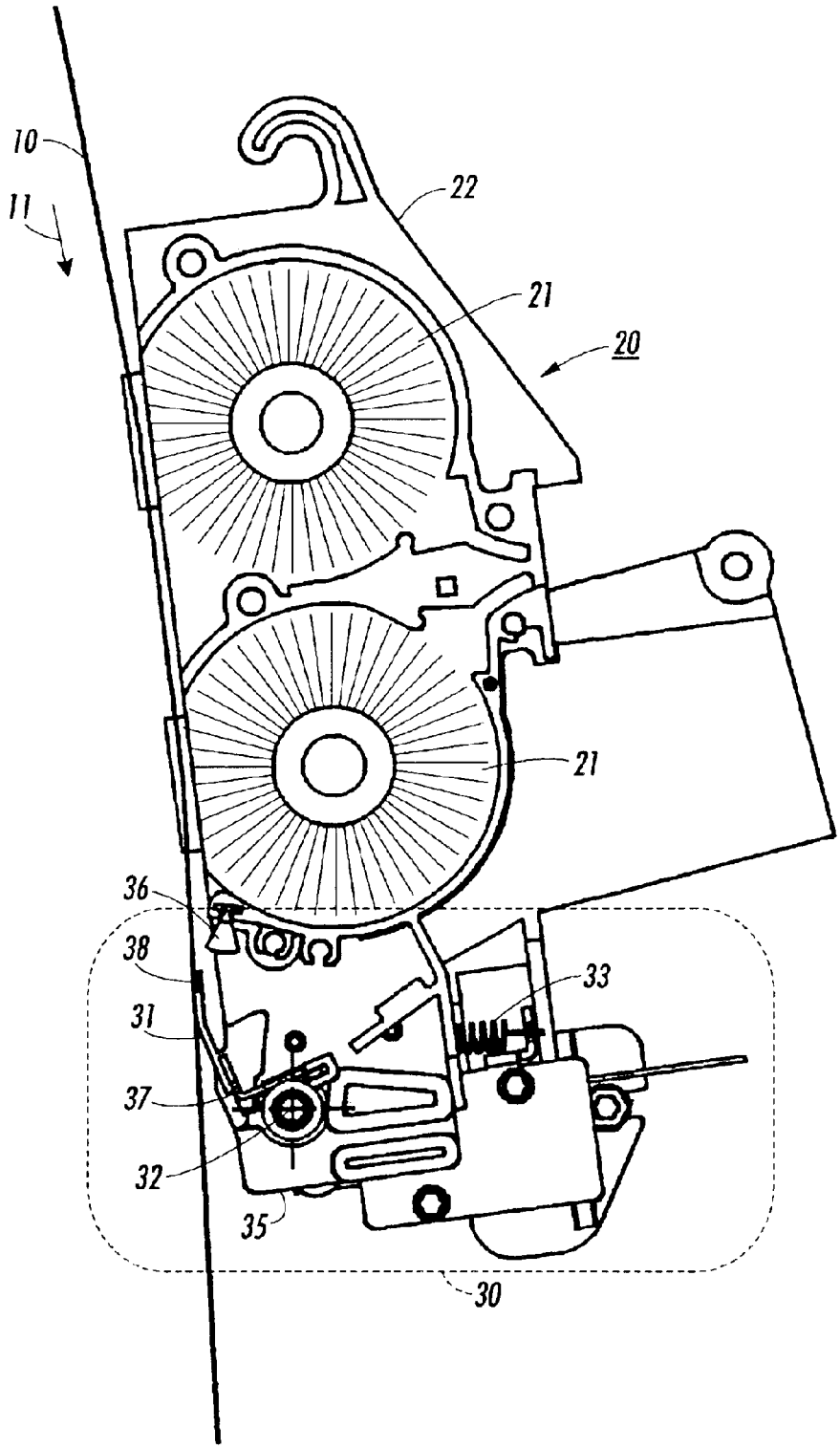
FIG. 1 is a plan view of one embodiment of the invention showing the cleaning blade in its engaged position as seen from one side of the apparatus.

For a general understanding of the present invention, reference is made to the drawings. In the drawings, like reference numerals have been used throughout to designate identical elements.

An exemplary electronic system comprising one embodiment of the present invention is a multifunctional printer with print, copy, scan, and fax services. Such multifunctional printers are well known in the art and may comprise print engines based upon ink jet, electrophotography, and other imaging devices. The general principles of electrophotographic imaging are well known to many skilled in the art. Generally, the process of electrophotographic reproduction is initiated by substantially uniformly charging a photoreceptive member, followed by exposing a light image of an original document thereon. Exposing the charged photoreceptive member to a light image discharges a photoconductive surface layer in areas corresponding to non-image areas in the original document, while maintaining the charge on image areas for creating an electrostatic latent image of the original document on the photoreceptive member. This latent image is subsequently developed into a visible image by a process in which a charged developing material is deposited onto the photoconductive surface layer, such that the developing material is attracted to the charged image areas on the photoreceptive member. Thereafter, the developing material is transferred from the photoreceptive member to a copy sheet or some other image support substrate to which the image may be permanently affixed for producing a reproduction of the original document. In a final step in the process, the photoconductive surface layer of the photoreceptive member is cleaned to remove any residual developing material therefrom, in preparation for successive imaging cycles. The present invention pertains primarily to this last cleaning step of the process.

The above described electrophotographic reproduction process is well known and is useful for both digital copying and printing as well as for light lens copying from an original. In many of these applications, the process described above operates to form a latent image on an imaging member by discharge of the charge in locations in which photons from a lens, laser, or LED strike the photoreceptor. Such printing processes typically develop toner on the discharged area, known as DAD, or "write black" systems. Light lens generated image systems typically develop toner on the charged areas, known as CAD, or "write white" systems. Embodiments of the present invention apply to both DAD and CAD systems. Since electrophotographic imaging technology is so well known, further description is not necessary. See, for reference, e.g., U.S. Pat. No. 6,069,624 issued to Dash, et al. and U.S. Pat. No. 5,687,297 issued to Coonan et al., both of which are hereby incorporated herein by reference.

Referring to FIG. 1, one embodiment of the present invention is shown in a plan view from one side of the embodiment. In this view, imaging surface 10, which may be a charge retentive surface such as a photoreceptor, is in the form of a endless loop belt. Imaging drums are also common, and the present invention is also applicable to imaging drums. Arrow 11 indicates the direction of travel of photoreceptor 10. The segment of photoreceptor 10 shown in FIG. 1 has, before arriving at the cleaning apparatus shown in FIG. 1, been charged, imaged, developed, and had its image transferred to a copy substrate. The primary cleaning system 20 shown in FIG. 1 comprises two electrostatic brushes 21 which are charged to attract residual toner particles and debris are rotated to brush against photoreceptor 10. Housing 22 serves to seal brushes 21 in a chamber in order to further cleaning by pulling a vacuum to remove loosened particles from the bristles of brushes 21. The combination of brushing friction, electrostatic charging of the brushes, and vacuum serves to remove most of the residual toner and debris left on imaging surface 10. In image-on-image systems, primary cleaning systems are known to retract from operative positions in order not to smear the unfused images layered on the imaging surface. See U.S. Pat. No. 5,493,383 issued to Pozniakas and hereby incorporated herein by reference. More information on such brush cleaning systems is found at U.S. Pat. No. 5,031,000, U.S. Pat. No. 4,989,047 cited earlier. As alternatives to brush cleaning systems, other primary cleaning systems can comprise, inter alia, flexible cleaning blades and electrostatic charging/vacuum systems.

Figure 3:
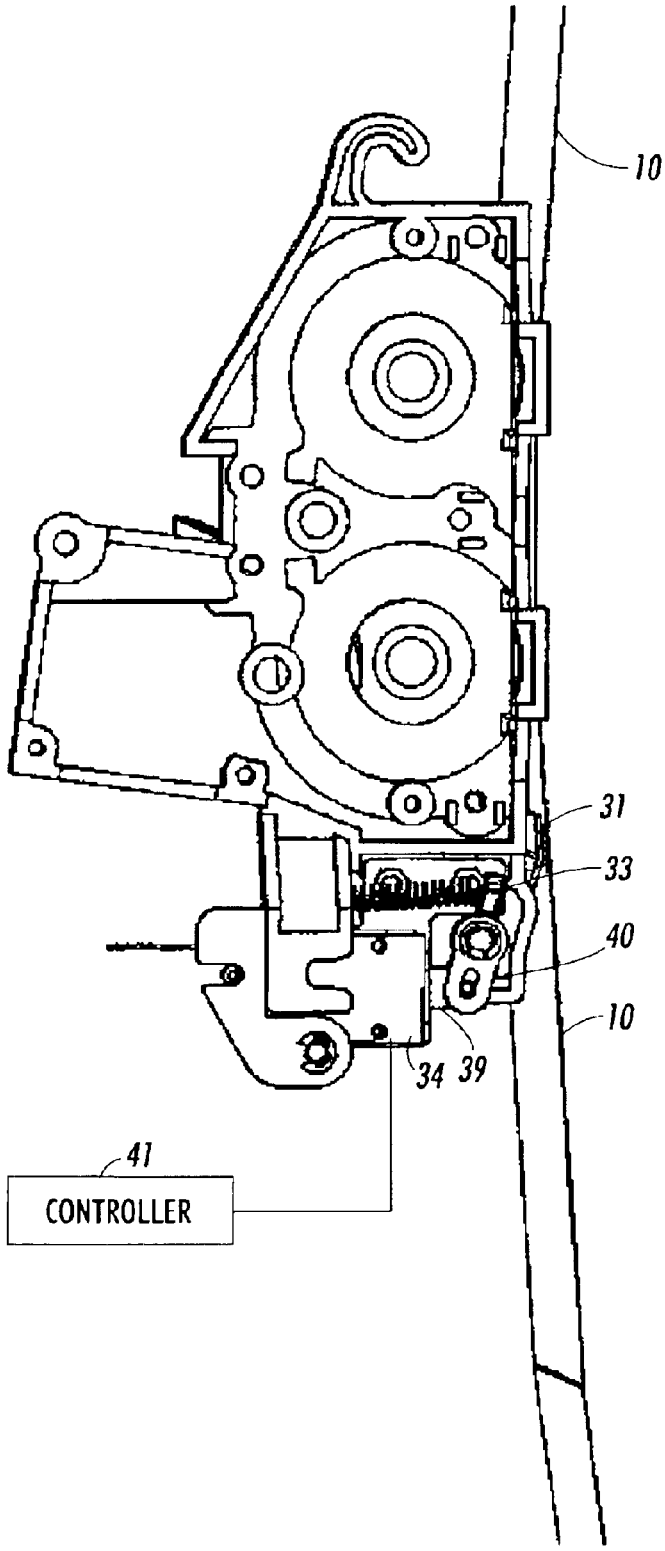
FIG. 3 is a plan view of the same embodiment showing the cleaning blade in its engaged position as seen from the opposing side of the apparatus.

Secondary spot cleaning system 30 is shown downstream from primary cleaning system 20 and is comprised, in this embodiment, of spot blade 31, pivot hinge 32, biasing means 33, forcing device 34 (shown in FIG. 3), debris catch tray 35, wiper mechanism 36, and controller 41 (shown in FIG. 3). In the embodiment shown in FIG. 1, spot blade 31 is in its engaged position and is in contact with and positioned to shear agglomerations from imaging surface 10. The load on blade 31 and the angle of attack between the blade and imaging surface 10 are selected to ameliorate frictional heating from the contact between the blade and imaging surface while applying sufficient pressure to shear agglomerations from the surface. The angle of attack is typically in the range of just greater than 0 degree to approximately 9 degrees with respect to the imaging surface. Additionally, the load on the blade is selected to be relatively low, in the range of 0 to 10 gm/cm, and preferably in the range of about 5–8 gm/cm. Design of the particular angle and load are affected by such matters as the thickness and free extension of the blade from the blade holder as well as the durometer value of the material used for the blade.

One aspect of the embodiment shown in FIG. 1 is a configuration that enables blade 31 to be retracted from contact with imaging surface 10 even when primary cleaner system 20 is fully engaged in its operative position. Such retraction reduces heat by intermittently allowing the blade to be released from frictional engagement with the photoreceptor and to thereby be cooled. When blade 31 is positioned primarily in the retracted rather than engaged position, frictional heating is minimized. As described above, frictional heat is one contributor to creation and adherence of agglomerations to imaging surface 10 and to the spot blade. Additionally, maintaining spot cleaning blade 31 primarily in the retracted position greatly reduces the amount of micro-scratching induced by blade 31 to imaging surface 10. Wear and scratching of imaging surface 10 are therefore lessened, and the service life of imaging surface 10 can be extended.

Experience indicates that few agglomerations adhere stubbornly to an imaging surface when first deposited. Adherence increases as the agglomeration is cycled through the imaging process. Since agglomerations often commence as micro-spots with no or very minor impact upon image quality, it is not necessary for blade 31 to be continually engaged with imaging surface 10. Although continual engagement is not necessary, sufficient engagement within a sufficient number of imaging cycles is important since agglomerations begin to grow in size and adhere more stubbornly to imaging surface 10 as imaging cycles are repeated. The goal is therefore to optimize the desire for minimal time of engagement with the need to clean agglomerations before they adhere too stubbornly. It is found that engagement between about 15 and about 30 percent of the duty cycle period during which imaging surface 10 is performing imaging is sufficient to remove agglomerations before subsequent removal becomes more difficult. An optimal period of engagement seems to be about 20 percent of the imaging duty cycle period. Another measurement of the period of engagement is that blade 31 should be engaged for less than about 2 of every 6 revolutions of the imaging surface and, preferably, for about one revolution in every 5 revolutions. When an imaging system is being run for diagnostic, machine set-up, maintenance or at other periods in which no ink or toner is being deposited or no copy substrate is being cycled through the machine, blade 31 can safely remain in its retracted position. Such retraction during non-imaging cycles also serves to preserve the imaging surface.

Referring again to FIG. 1, blade 31 is shown in its engaged position. Forcing device 34 (shown in FIG. 3) has actuated to rotate blade holder 37 around pivot point 32 from the retracted to the engaged position. Biasing mechanism 33 urges blade 31 toward the retracted position, but forcing device 34 has overcome the biasing force to push blade 31 into engagement. The angle of attack and the load forces upon blade 31 are optimally within the limits described above. The portion of cleaning blade 31 that provides the shearing action to the imaging surface is cleaning edge 38.

Figure 2:
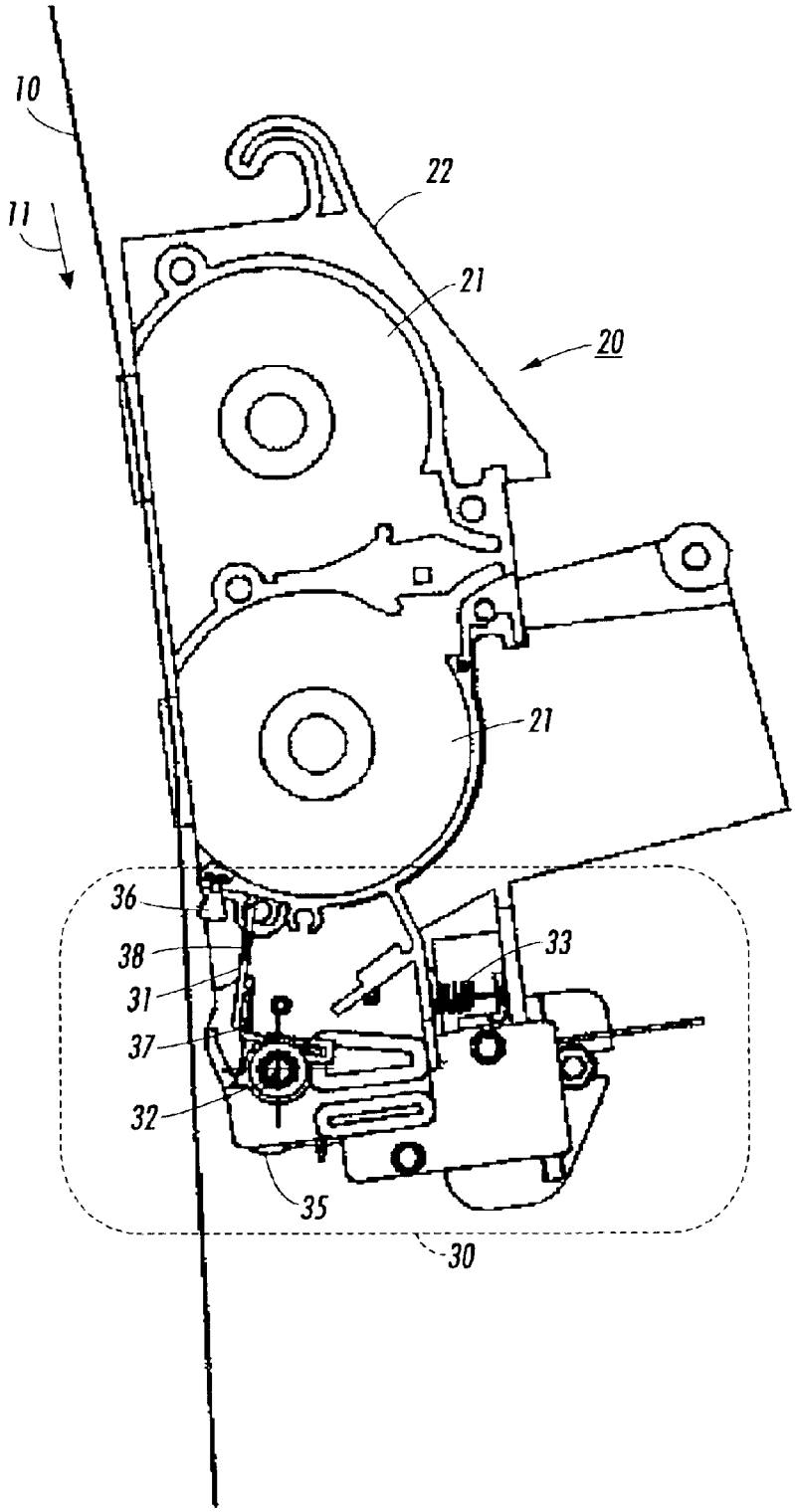
FIG. 2 is a plan view of the same embodiment showing the cleaning blade in its retracted position as seen from the same side of the apparatus.

FIG. 2 shows the secondary cleaning system with spot cleaning blade 31 in its retracted position. A comparison of FIGS. 1 and 2 reveals that the travel of blade 31 between engaged and disengaged positions has moved cleaning edge 38 through engagement with wiper mechanism 36. Wiper mechanism 36 can comprise any of a number of cleaning mechanisms, including, without limitation, brushes, soft abrasive materials with sponge-like qualities, another cleaning blade, and an air-source to blow debris off the cleaning edge. One embodiment is a polypropylene sponge-like soft abrasive material less than 0.5 centimeters thick extending along essentially the full length of cleaning edge 38. In the embodiment shown, debris is brushed from cleaning edge 38 as the cleaning edge travels both to and from its engaged position. By removing such debris instead of allowing it to accumulate on the cleaning edge, micro-scratching of imaging surface 10 is further ameliorated since the abrasive agglomerations are substantially removed. Also shown in FIG. 2 is catch tray 35 which extends underneath cleaning blade 31 to prevent removed agglomerations and other toner and debris from falling into other portions of the imaging system and causing degradation of other systems.

Figure 6:
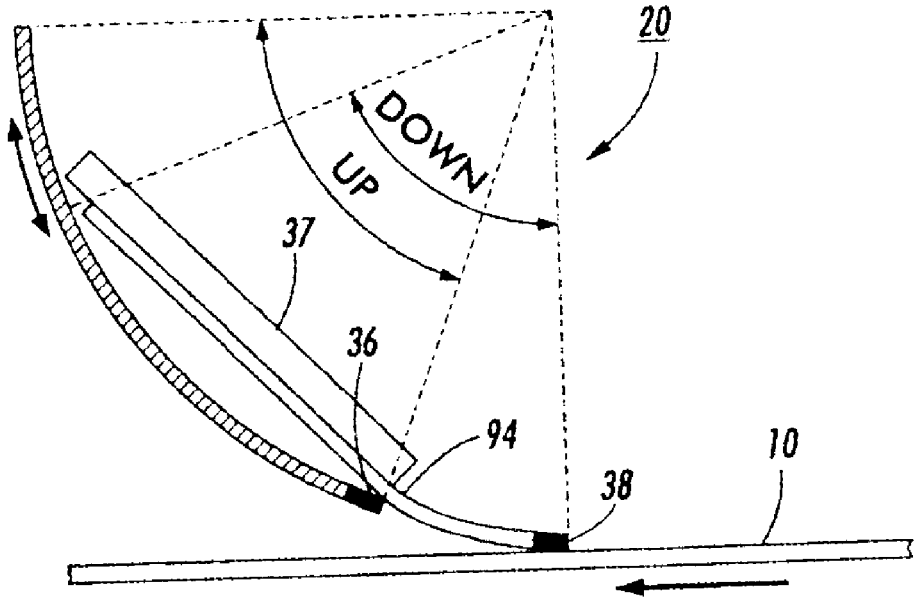
FIG. 6 is an alternative embodiment showing a fixed blade holder with a movable wiper mechanism.

FIG. 3 is a plan view of the embodiment of FIGS. 1 and 2 as seen from the opposing side of cleaning system 30. As shown, cleaning blade 31 is again in its engaged position. A full view of biasing mechanism 33 is shown. Biasing mechanism 33 can be any mechanism for urging blade 31 into either its engaged or its retracted position. Such biasing mechanisms can include, without limitation, springs, gravity influenced systems, and any other mechanism that stores potential energy, including positioning blade 31 and blade holder 37 such that the resiliency of the blade itself presses the blade toward imaging surface 10. FIG. 6 below shows an example of biasing using blade resiliency. Opposing the urging force of biasing mechanism 33 is forcing device 34. In the embodiment shown, forcing device 34 comprises a solenoid with plunger 39 linked by lever 40 to blade holder 37 (linkage not shown). When the solenoid is actuated upon signals form controller 41, plunger 39 pulls its end of lever 40 toward the solenoid with force enough to overpower the biasing force of biasing mechanism 33. The result is that blade holder 37 and cleaning blade 31 are pulled toward the engaged position as described in relation to FIGS. 1 and 2. One skilled in the art will recognize that the roles of biasing mechanism 33 and forcing device 34 can be reversed and that the solenoid can be either a rotating solenoid or a linear solenoid and that a linear solenoid can be either of a push or a pull type. Additionally, forcing device 34 can be any number of devices other than a solenoid. For instance, a stepper motor can easily be substituted to achieve the same effect.

Figure 4:
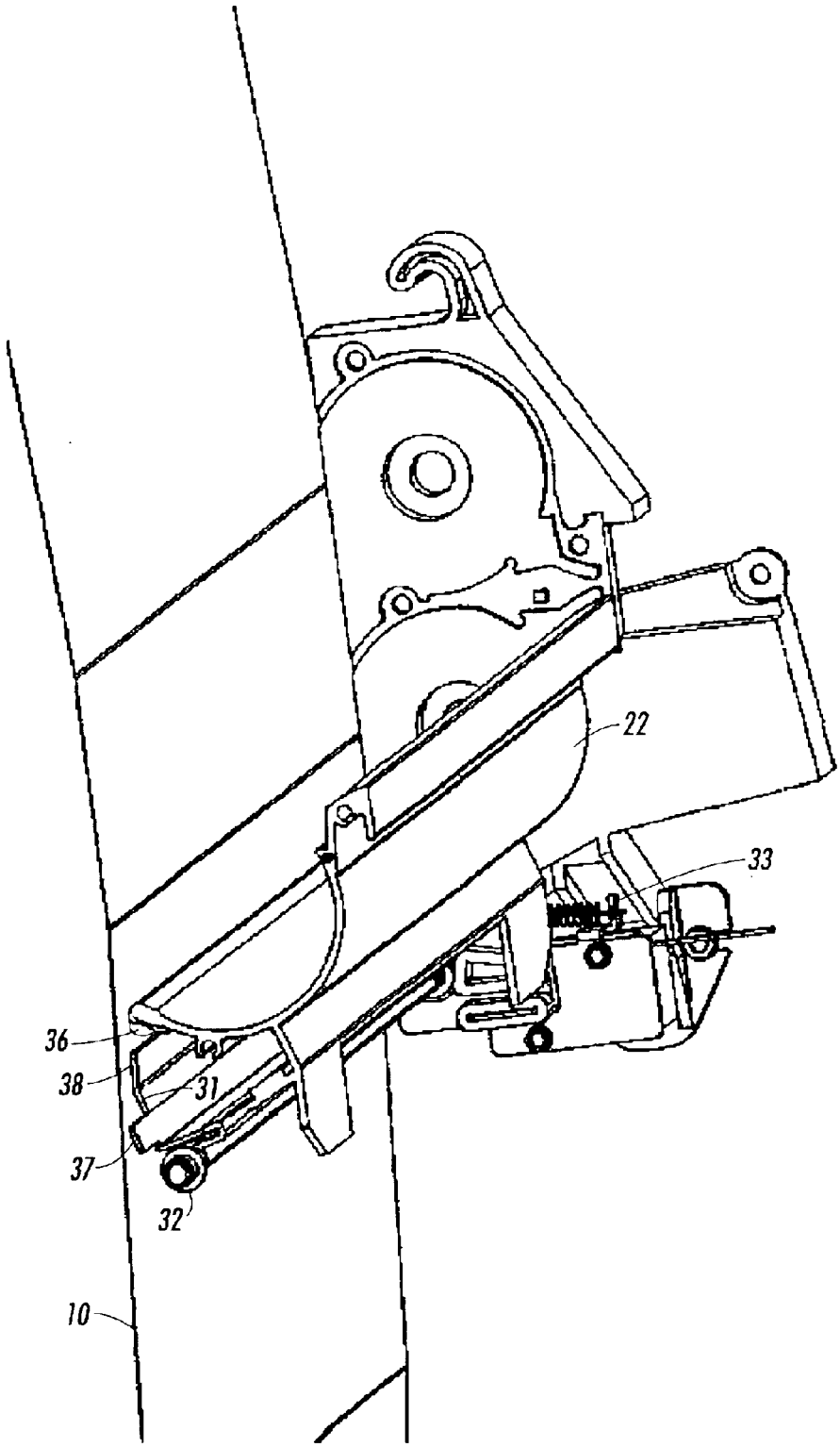
FIG. 4 is a perspective view of the embodiment showing the cleaning blade in its engaged position.

A perspective view of the embodiment shown in FIGS. 1–3 is shown in FIG. 4. In this view, brushes 21 have been removed. As shown, blade 31 with its cleaning edge 38 extends virtually the entire width of imaging surface 10 in order to provide the cleaning for the full width of the imaging path. In the configuration shown, blade 31 is in its engaged position.

Figure 5:
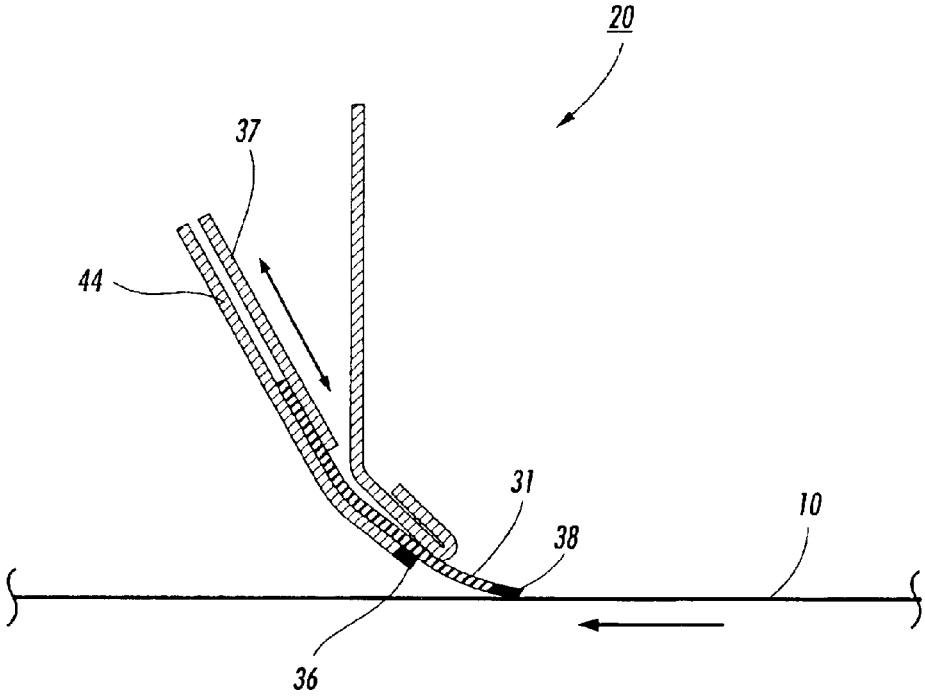
FIG. 5 is an alternative embodiment showing a cleaning blade capable of moving reciprocally.

Many other embodiments of the invention are possible. For instance. FIG. 5 shows an alternative embodiment in which a forcing mechanism (not shown) causes cleaning blade 31 to reciprocate between engaged and retracted positions rather than pivot between such positions. In the embodiment shown, wiper mechanism 36 is located at the tip of guide baffle 44. Yet another embodiment is shown in FIG. 6, where blade holder 37 remains stationary while wiper mechanism 36 is moved in a pivotal motion that allows the resiliency of blade 94 to move cleaning edge 38 into an engaged position when wiper 36 is retracted and that pushes blade 94 into its retracted position when wiper 36 is extended. In this embodiment, cleaning occurs when cleaning mechanism 36 is fully extended to reach cleaning edge 38.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A cleaning system for removing residual toner from an imaging surface, comprising:

a primary cleaner for removing the predominant amount of residual toner and debris, such primary cleaner having an operative position;

a blade holder;

an agglomeration cleaning blade mounted in the blade holder at a position downstream from the primary cleaner, said cleaning blade having a cleaning edge; and a forcing device for moving the blade between a first and a second position wherein the first and second position are selected from the group consisting of an engaged position and a retracted position;

wherein, when the blade is moved into the engaged position, the cleaning edge is supported at a low angle of attack in engagement with the imaging surface at a relatively low load, for shearing release of agglomerations from the imaging surface and wherein the cleaning blade is movable to the retracted position during periods in which the primary cleaner is in its operative position.

2. The cleaning system of claim 1, further comprising a wiper mechanism wherein, when the blade is moved to the retracted position, the wiper mechanism removes sheared agglomerations from the cleaning edge.

3. The cleaning system of claim 2, wherein the wiper mechanism comprises a sponge-like material.

4. The cleaning system of claim 2, wherein the wiper mechanism comprises a wiper blade.

5. The cleaning system of claim 1, further comprising a catch tray situated to catch agglomerations sheared by the cleaning edge.

6. The cleaning system of claim 1, wherein the forcing device is a solenoid.

7. The cleaning system of claim 1, wherein the forcing device is a motor.

8. The cleaning system of claim 1, further comprising a biasing mechanism for biasing the blade holder toward an initial position selected from the group consisting of the engaged position and the retracted position.

9. The cleaning system of claim 8, wherein the biasing mechanism comprises a spring.

10. The cleaning system of claim 1, wherein the primary cleaner comprises a rotating electrostatic brush.

11. The cleaning system of claim 1, wherein the blade holder is pivotally mounted and wherein the forcing device causes pivotal motion between the engaged and the retracted positions.

12. The cleaning system of claim 1, wherein the forcing device causes the blade holder to move reciprocally between the engaged and retracted positions.

13. The cleaning system of claim 1, wherein the forcing device exerts its force upon a wiper mechanism and wherein movement of the wiper mechanism causes the cleaning blade to move between the engaged and the retracted positions.

14. The cleaning system of claim 1, wherein the imaging surface has a duty cycle period during which it is imaged and wherein the cleaning blade is moved to the engaged position between about 15 to about 30 percent of the duty cycle period.

15. The cleaning system of claim 14, wherein the cleaning blade is moved to the engaged position about 20 percent of the duty cycle period.

16. The cleaning system of claim 1, wherein the imaging surface comprises a revolving endless loop and wherein the cleaning blade is engaged for less than 2 revolutions in every 6 revolutions.

17. The cleaning system of claim 16, wherein the cleaning blade is engaged during about one revolution in about every 5 revolutions.

18. The cleaning system of claim 1, wherein the cleaning blade is in the retracted position during non-imaging periods.

19. The cleaning system of claim 1, wherein the cleaning blade is in the retracted position during duty cycle periods in which no copy substrate contacts the imaging surface.

20. The cleaning system of claim 1, wherein the imaging surface is a charge retentive surface and wherein the cleaning system comprises a cleaning system within an electrostatographic imaging system.

21. A process for cleaning agglomerations from an imaging surface, comprising:

removing the predominate amount of residual toner and debris from the imaging surface by a primary cleaner mechanism;

engaging a cleaning edge of a cleaning blade with the imaging surface at a low angle of attack at a relatively low load for shearing release of agglomerations from the imaging surface;

retracting the cleaning blade from the position in which it is engaged with the imaging surface; and cleaning the retracting cleaning blade by engaging the cleaning edge with a wiper mechanism.

22. The process of claim 21, wherein engaging occurs between about 15 and about 30 percent of a duty cycle period of the imaging surface.

23. The process of claim 22, wherein engaging occurs about 20 percent of a duty cycle of the imaging surface.

24. The process of claim 21, wherein the imaging surface comprises a revolving endless loop and wherein engaging occurs during less than about 2 revolutions in about every 6 revolutions of the endless loop.

25. The process of claim 24, wherein engaging occurs during about one revolution in about every 5 revolutions.

26. The process of claim 21, wherein engaging is avoided during non-imaging periods.

27. The process of claim 21, wherein engaging is avoided during duty cycle periods in which no copy substrate contacts the imaging surface.

* * * * *